US006712940B2

(12) United States Patent
Crook

(10) Patent No.: US 6,712,940 B2
(45) Date of Patent: Mar. 30, 2004

(54) PAPERMACHINE BELT

(75) Inventor: Robert L. Crook, Wilson, NC (US)

(73) Assignee: Voith Fabrics Heidenheim GmbH & Co. KG, Heidenheim (DE)

( * ) Notice: Subject to any disclaimer, the term of this patent is extended or adjusted under 35 U.S.C. 154(b) by 0 days.

(21) Appl. No.: 09/791,128

(22) Filed: Feb. 22, 2001

(65) Prior Publication Data

US 2002/0060058 A1 May 23, 2002

(30) Foreign Application Priority Data

Feb. 23, 2000 (GB) ..... 0004102
Mar. 7, 2000 (GB) ..... 0005318

(51) Int. Cl.[7] ..... D21F 2/00; B32B 5/06; B32B 27/00; D03D 3/04; D03D 7/00

(52) U.S. Cl. ..... 162/306; 162/358.4; 162/901; 442/271; 442/275; 442/283; 442/286; 428/138; 428/297.4

(58) Field of Search ..... 162/205, 206, 162/306, 348, 358.2, 358.4, 900–904; 139/383 A, 383 AA, 425 A; 442/50, 221, 268, 270–272, 275, 277, 280, 281, 283, 286, 301; 428/131, 137, 138, 911, 222; 156/148

(56) References Cited

U.S. PATENT DOCUMENTS 4,427,734 A * 1/1984 Johnson ..... 442/324
4,439,273 A * 3/1984 Curry ..... 162/358.2
4,446,187 A * 5/1984 Eklund ..... 428/136
4,552,620 A * 11/1985 Adams
4,565,735 A * 1/1986 Murka et al. ..... 442/324
4,701,368 A * 10/1987 Kiuchi et al. ..... 442/226
4,772,504 A * 9/1988 Andresen ..... 428/96
4,798,760 A * 1/1989 Diaz-Kotti ..... 442/35
4,806,413 A * 2/1989 Penven ..... 428/222
4,851,281 A * 7/1989 Wood ..... 442/225
4,976,821 A * 12/1990 Laapotti
5,328,757 A * 7/1994 Kenney et al. ..... 442/268
5,372,876 A * 12/1994 Johnson et al. ..... 442/271
5,618,612 A * 4/1997 Gstrein ..... 442/189
5,888,915 A * 3/1999 Denton et al. ..... 442/200
5,945,358 A * 8/1999 Marchand ..... 442/200
6,159,880 A * 12/2000 Schiel ..... 442/189
6,383,339 B1 * 5/2002 Gstrein ..... 428/96
6,436,240 B1 * 8/2002 Jeffrey ..... 428/136

FOREIGN PATENT DOCUMENTS

EP 0 107 606 * 5/1984
EP 0 576 115 * 12/1993

* cited by examiner

*Primary Examiner*—Steven P. Griffin
*Assistant Examiner*—Eric Hug
(74) *Attorney, Agent, or Firm*—Caesar, Rivise, Bernstein, Cohen & Pokotilow, Ltd.

(57) ABSTRACT

A papermachine belt particularly for use in a press and/or dryer section comprises a support fabric, a minimal nonwoven layer on the support fabric, a fusible thermoplastic layer, and a thicker batt over the thermoplastic layer. The whole structure is needled together, and the thermoplastic layer melted so that it is expressed through the overlying batt. The layer may be substituted by a nonwoven fabric containing composite yarns with thermoplastic sheaths or such yarns wound spirally around the belt. The support fabric may be substituted by a perforated composite membrane.

14 Claims, 2 Drawing Sheets

PAPERMACHINE BELT

This invention relates to papermachine belts, particularly to support belts for avoiding unsupported draws for example between the press and dryer sections of the machine, and more especially to planar belts having the capability of imparting a smoothing effect to the paper web in the press.

An early disclosure of a support belt arrangement in a papermachine is EP-A-107,606 (Beloit), in which it was established that the belt should be impervious to water, to avoid re-wetting the paper web, have a smooth surface, and hardness similar to a plain press roll cover.

U.S. Pat. No. 4,652,620 (Adams) discloses a papermachine belt comprising a fabric base, such as a woven scrim, which is spray coated with a urethane coating on one surface of the fabric which impregnates the fabric to a substantial depth of at least one-half of the thickness of the scrim. The coating is characterised by the presence of a myriad of small isolated closed bubbles or pores providing a stone-like closed structure. The fabric may also be coated on both surfaces and the coating may be coated with a more dense urethane coating providing a gloss finish. This belt is designed as a carrier for conveying paper through pressure nips such as in the press section of a papermachine and the finish provided by the coating enables the belt to release the paper web after the nip without damage. This belt is not envisaged as being suitable for use as a support and/or smoothing belt.

U.S. Pat. No. 4,976,821 (Laapotti) discloses a papermachine press section which features two separate successive press nips between which the web passes in a closed draw, supported by a conveying fabric. This latter is disclosed as being preferably relatively impervious and produced for example by impregnating an ordinary press felt with an appropriate plastics material, and may in some uses be to some extent pervious and/or water receiving although to a considerably lesser degree than ordinary press felts.

EP-A-576115 discloses a transfer belt wherein sheet release for transfer is assisted by incorporating particles which under pressure are compressed into the belt matrix, but on release of pressure at the web release point, stand proud of the belt surface and thus create a temporary roughening of the surface, which aids sheet release.

It is an object of the present invention to provide a papermachine belt which is capable of acting both as a draw eradication belt, and also as a medium for smoothing the surface of the paper web.

According to the invention, a papermachine belt comprises a support structure, having a layer of thermoplastic material formed on at least one face of the support structure, further fibrous and yarn-material being at least partially embedded in said thermoplastic layer.

The layer of thermoplastic material may be provided in the form of a porous membrane of material such as a thermoplastic polyurethane elastomer, which is laid on one surface of a press felt base fabric. Fibrous material in the form of non-woven batt is then placed on top of the membrane and the whole structure is then needled. The felt is then heated on the side nearest to the membrane ie. the papercontacting face, which results in the melted polyurethane passing from the inside to the outside surface through the batt.

By varying the heat, pressure and dwell time, the distribution of fibres can be controlled In some cases, a surface totally free of fibres may be desired, and in other cases, fibre in the surface may be required. This greater control arises because the membrane is within the structure and flows out to the surface, rather than flowing inwards from the outside.

The felt according to the invention may comprise a membrane carried on a woven base cloth with minimal amount of batt needled on top, and a further batt on top of the membrane, the whole structure then being needled together and then heat applied on the side of the belt nearest the membrane. Alternatively, the further batt over the membrane may be omitted.

In another embodiment, the thermoplastics material may be a cast sheet of e.g. thermoplastic elastomeric polyurethane which is introduced onto the surface of the pressfelt. Sufficient heat and pressure may then be applied to give a surface laminate structure or to give a composite whereby the material impregnates the felt, whilst maintaining impermeability.

The woven base cloth may be made by weaving bi-component yarn in either the running and or the cross-machine directions. Batt is placed over this, with the possibility of a support fabric being additionally provided.

The felt is then fused, heat being applied to the side closest to the meltable yarns.

The press felt base cloth may incorporate separately helically wound bi-component yarns.

The use of batt on top of the base fabric is advantageous as it offers frictional resistance to the yarns.

Batt is also preferably needled onto the yarns, thus effectively trapping the yarns and so preventing splaying prior to heating. This could be of particular importance if the endless felt has to be heated upside down on rollers in order for the side closest to the membrane to be in contact with the heater.

The resulting belt is preferably completely impervious to water, or of very low permeability, in the range for example 0–50 cfm at 12.5 mm WG.

Preferred embodiments of papermachine belt according to the invention will now be described, with their methods of manufacture, by way of example, and with reference to the accompanying drawings, wherein.

Figure 1:
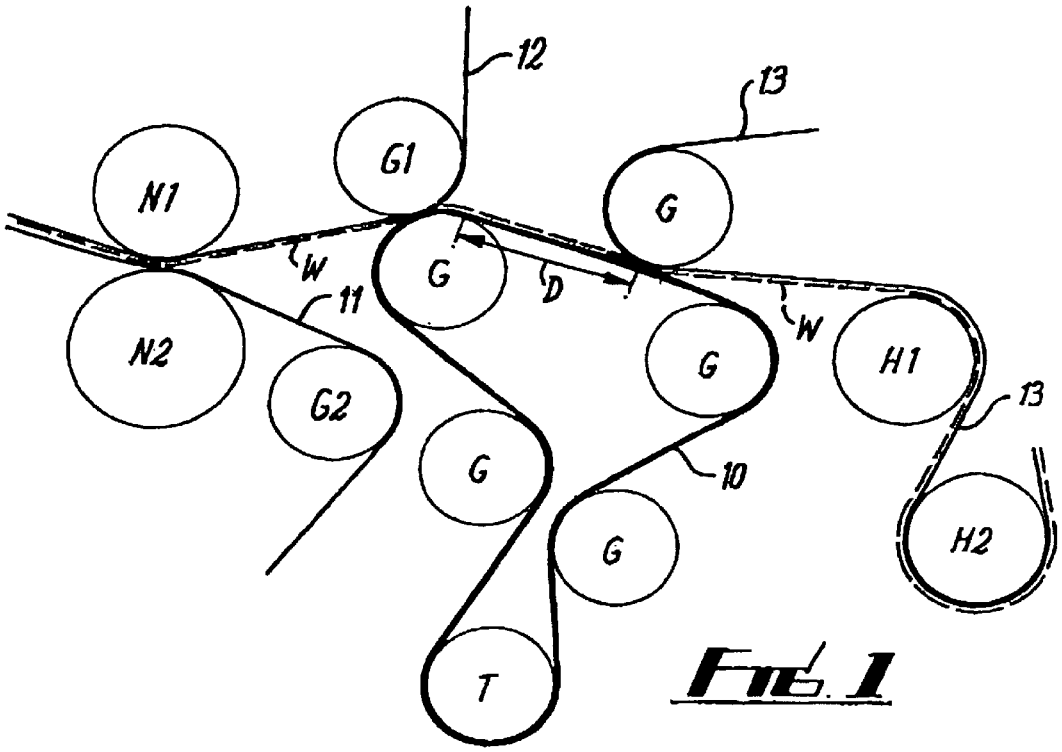
FIG. 1 is a diagram of the press-section/dryer section transfer zone in a papermachine showing one use of a papermachine belt according to the invention as a conveying belt.
Figure 2:
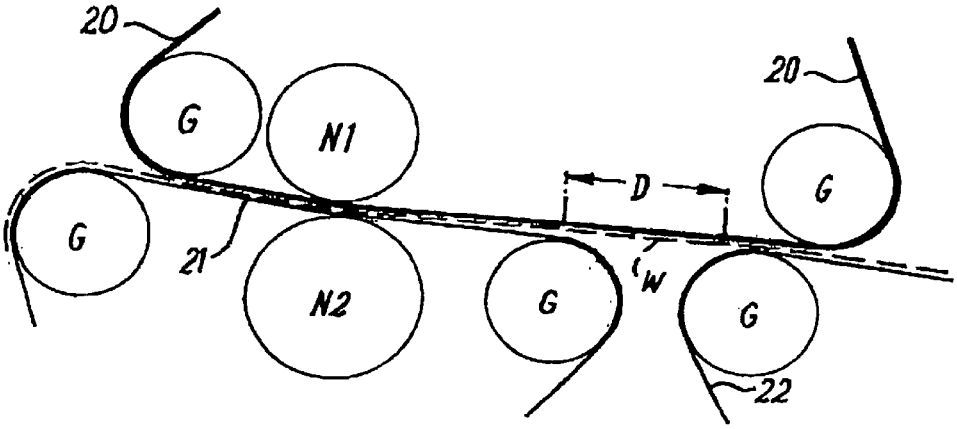
FIG. 2 is a diagram of the press-section of a papermachine showing a further use of a papermachine belt according to the invention as a web support and smoothing belt.
Figure 7:
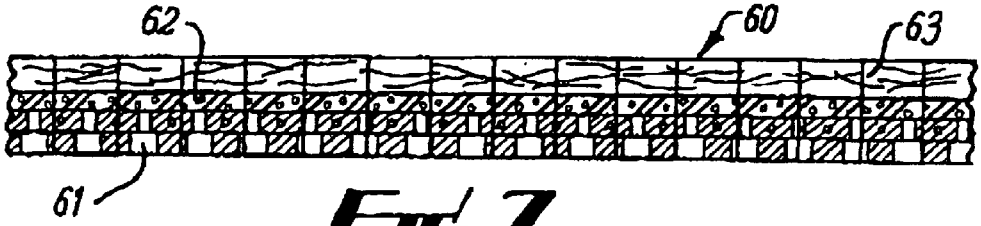

FIG. 7 is a similar view of a fifth embodiment of a papermachine belt according to the invention; and FIGS. 1 and 2 illustrate possible uses of a papermachine belt according to the invention, which is suitable for use as a conveying belt and/or for smoothing the finish of a paper web carried by the belt. The figures are merely schematics and do not represent the true roller configurations in a papermachine.

In FIG. 1, a belt 10 according to the invention (heavy lines) is used as a conveying belt to carry a paper web W from the press section (felts 11,12, main nip rollers N1 and N2 and Guide rolls G1,G2) of a papermachine to the dryer section of the papermachine, (dryer fabric 13, heated rollers H1-H2), over the draw D, which would otherwise be an open draw in which the web was unsupported. The well known advantage of providing a closed draw is that the web is supported, is not so prone to breakages, and the machine can be operated at higher speeds than when an open draw is present.

In FIG. 2, a belt 20 according to the invention is used in the press section of a papermachine as a web smoothing belt, as well as a web support belt, bridging the draw D. The web W (broken line) is supported through the press nip N1, N2, by a felt 21, which is a normal press felt. The belt 20 according to the invention (heavy line) acts as a support belt and smoothing belt and conveys the web W between the felts 21 and 22.

However, the belt according to the invention can substitute for a press belt in any press configuration, and is able to transfer a paper sheet between presses or from the last press to the first dryer.

Figure 3:
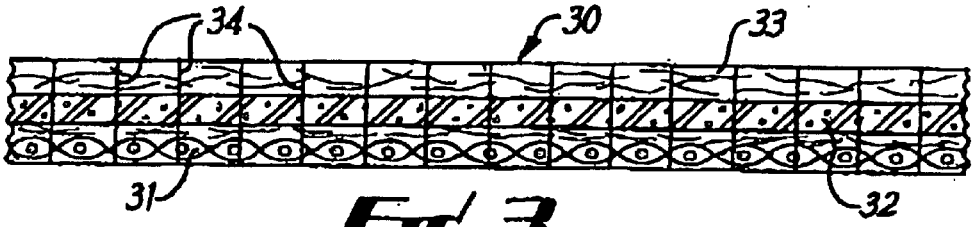
FIG. 3 is a diagrammatic cross-section of the components of a first embodiment of papermachine belt according to the invention before fusing.

FIG. 3 shows a cross-section in diagrammatic form of a papermachine belt 30 according to the invention at a stage in its manufacture immediately prior to treatment with heat and pressure. In the manufacture of the belt, a woven base fabric with minimal batt needled thereto 31, which provides a support structure, has a membrane 32 of a thermoplastic material, in this case a partially porous thermoplastic polyurethane elastomer membrane, laid onto its upper surface. A fibrous batt layer 33 is placed over the polyurethane membrane and the batt is then needled (indicated by vertical lines 34) through the polyurethane membrane and into the base fabric 31.

In the next and final stage, after the needling, the composite structure is subjected to heat and pressure such as by tensioning of the endless fabric around a heated roll. This fuses the polyurethane membrane and causes the fused thermoplastic polyurethane to flow out through the fibrous batt until all but a predetermined proportion of the batt is embedded in the thermoplastic.

This produces a resinous surface with embedded fibres which can assist with the controlled separation of the sheet and the belt so controlling the amount of draw. The belt formed is essentially impermeable but if desired a small degree of permeability can be provided for, by the selection of the batt fibres, as well as the heat pressure and dwell time involved. The belt does not function as a dewatering element, but the provision of a passageway for a small amount of air and/or water may facilitate easier sheet release, and the permeability is thus advantageously in the range of 0–60 cfm at 12.5 mm WG. The belt 30 is able to improve web smoothness and have the ability to convey the web while being extremely stable, tough and having a wear resistant surface which is immune to delamination. The permeability and sheet release properties can be engineered for different applications.

Figure 4:
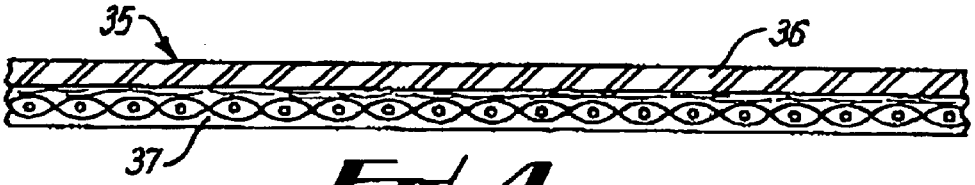
FIG. 4 is a diagrammatic cross-section of a second embodiment of papermachine belt according to the invention.

FIG. 4 illustrates a second embodiment of belt 35 comprising a nonporous polyurethane thermoplastic elastomer membrane 36, on a woven support 37, with a thin batt layer there between. The permeability and other properties of the membrane 36 are similar to those of layer 32 in FIG. 3.

Figure 5:
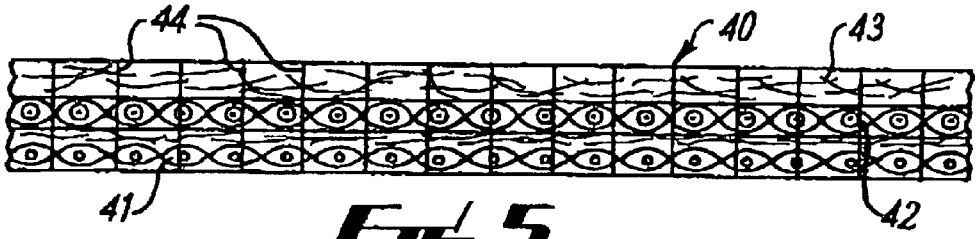
FIG. 5 is a diagrammatic cross-section of a third embodiment of papermachine belt according to the invention.

FIG. 5 illustrates a third embodiment of belt 40 according to the invention, prior to heat treatment. A woven base fabric with minimal batt needled thereto 41 has a further woven fabric 42 applied thereto. The further fabric 42 is woven from sheath-core bicomponent yarns each comprising a higher melting point core, and a lower melting point material sheath, A nonwoven batt 43 is placed over the further fabric 42, and needled (indicated symbolically by vertical lines 44) into the base fabric 41 and further fabric 42.

Heat, pressure and tension are then applied, using a heated roller with the belt on a stretcher, and the lower-temperature melting sheaths of the yarns of the fabric 42 are fused and the melted thermoplastic layer thus formed pressed out through the fibres of the batt 43.

As before, the proportion of fibres remaining proud of the plastics layer can be controlled to determine the re-wetting and web release properties of the belt.

In the FIG. 5 embodiment, the fabric 42 may be wound onto the base fabric 41 in strips, and need not be co-extensive with the base fabric, ie. need not cover all the area of the base fabric.

Figure 6:
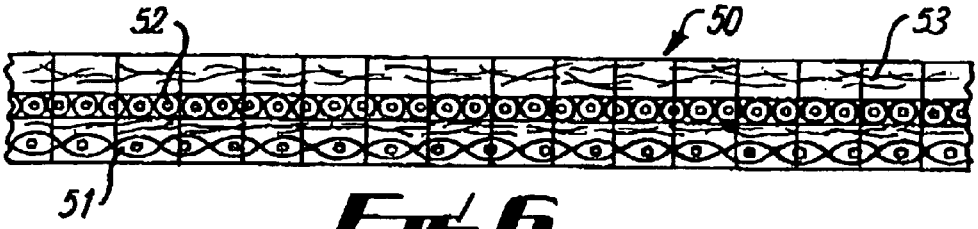
FIG. 6 is a similar view of a fourth embodiment of papermachine belt according to the invention.

The further embodiment illustrated in FIG. 6, of belt 50 comprises a woven base with minimal bat 51, and batt 53 with between them a layer of bi-component sheath-core yarns 52 wound onto the base fabric to provide the thermoplastic layer after fusion of their sheath components.

In FIG. 7, the belt 60 has a support structure comprised of a double layer of a foraminous plastics membrane 61, with reinforcing yarns supporting a thermoplastic elastomeric polyurethane fusible layer 62, and a needled batt 63. The membrane 61 may be of a relatively high melting point material.

In the above embodiments, the belt is preferably an endless belt, and the layers applied to the basic press felt, are wound onto the belt from rolls as the felt is rotated.

The topography of the surface of the belt may in some embodiments be designed to aid sheet release. It may for example be roughened by micro-embossing using engraved embossing rollers. A paper web will always follow the smoothest path and thus it is essential for a support belt to be smooth to successfully pick up the web. However at the release point ideally the support belt needs to be less smooth. Conveying may be aided by the use of a vacuum roller, but design of the belt surface can also achieve this.

In some embodiments of the present invention, such as that of FIG. 7, the membrane 61 or fusible layer 62 may incorporate yarns running in one direction, which remain intact after fusion of the membrane, and these remain proud of the belt surface when the belt is not subject to nip pressure. When compressed however they recede into the thermoplastic matrix and allow the belt surface to become flat, On leaving the nip the yarns re-emerge above the surface plane, and release the paper web.

The belt in the embodiment described is a composite structure wherein the layers have been amalgamated to give an integral structure, and not merely laminated.

Variations may be made to the embodiments described and other embodiments are possible, within the scope of the invention as set out hereinafter.

In variations of the invention, the thermoplastic polyurethane may be pre-treated with an isocyanate tie-coat in order to give improved adhesion to polyamide yarns used in the press felt. The polyurethane may be modified by inclusion of a fluoropolymer in the melt, or as a coating, to lower the surface energy of the belt to give improved sheet release properties, an alternative addition to improve sheet release properties is ultra high molecular weight (uhmw) silicone blockers.

In place of thermoplastic polyurethane elastomer materials in any of the above embodiments, the thermoplastic material used may be selected from the following materials for example:

1. Co-polymers of polyethylene and polyvinyl acetate (PVAC), for example ELVAX (Trade Mark).
2. Polyether block amides, such as VESTAMID, (Trade Mark) which is based on PA12; PEBAX (Trade Mark).

based on PA12 and PA6, or GRILAMID (Trade Mark), also based on PA12 and PA6.

3. Polyester elastomers, such as HYTREL, ARNITEL, RITEFLEX or ECDEL (all Trade Marks)
4. Ionomers, such as SURLYN (Trade Mark)
5. TPE/PVC blends.
6. Melt processable rubbers e.g. ALCRYN (Trade Mark)
7. Polysiloxanes.

The surface energy or texture in particular of the paper side surface may be modified by the use of suitable coatings or treatments, such as roughening of the surface, or treatment with ionised materials.

The felt construction of the present invention provides an integral structure which has a thermoplastic layer embedded within the felt which can be melted at a controlled temperature and pressure to engineer the appropriate surface for a particular use. Provision of an embedded thermoplastic layer which is expressed through a superposed fibrous layer avoids many problems arising from using a thermoplastic surface layer. The degree of fibre exposure at the surface can thus be controlled which is advantageous with respect to the ability to vary the smoothness and sheet release properties depending on the use.

The belt can be cut for seam flap preparation, as in a normal felt seam, and the belt installed on the machine in tent form, Then polyurethane film, granules or coated yarn are added over the seam loops between the cut ends and the seam is laid flat, pinching the added material between the seam flap or flaps. This may be carried out over a metal roll, or over a metal plate held in place magnetically below the seam The polyurethane is then sealed by softening with ultrasonic or thermal energy over and within the seam to provide a homogenous non marking surface.

What is claimed is:

1. A papermachine belt comprising a support structure having a porous base fabric, a layer of thermoplastic material provided on one face of the support structure, a thin nonwoven layer between the base fabric and the layer of thermoplastic material, and a nonwoven batt placed on top of the layer of thermoplastic material, wherein the whole structure is needled and the thermoplastic material melted to at least partially penetrate the batt.

2. The papermachine belt according to claim 1, wherein the belt has a paper contacting face and is heated from the paper contacting face to melt the thermoplastic material so that melted thermoplastic material passes from the inside to the outside surface through the batt.

3. The papermachine belt according to claim 1, wherein the support structure is a woven base cloth.

4. The papermachine belt according to claim 1, wherein said layer of thermoplastic material is a porous thermoplastic membrane secured over the nonwoven layer, and woven base cloth having said thin nonwoven layer thereon.

5. The papermachine belt according to claim 4, wherein said porous thermoplastic material includes a perforated nonwoven membrane.

6. The papermachine belt according to claim 1, wherein the support structure includes at least one foraminous plastic membrane.

7. The papermachine belt according to claim 1, wherein the layer of thermoplastic material is formed from a woven fabric incorporating bi-component yarns, the sheaths of which have been melted by heat under pressure.

8. The papermachine belt according to claim 1, wherein said layer of thermoplastic material includes an array of parallel bi-component yarns.

9. The papermachine belt according to claim 1, said support sturcture including a lower woven fabric and an upper woven fabric separated by a nonwoven batt, wherein the upper woven fabric constitutes said layer of thermoplastic material and includes warp or weft bi-component yarns having thermoplastic sheaths, the whole structure needled together, and heated to melt the sheaths of the bi-component yarns.

10. The papermachine belt according to claim 1, wherein said layer of thermoplastic material includes bi-component yarns having sheaths superposed thereon, said nonwoven batt being placed over the bi-component yarns having been melted by an application of heat to the structure.

11. The papermachine belt according to claim 1, wherein the thermoplastic material is selected from the group comprising:

(a) thermplastic polyurethane elastomers;

(b) co-ploymers of polyurethane and polyvinyl acetate;

(c) polymer block amides;

(d) polyster elastomers;

(e) ionomer thermoplastics;

(f) melt processable rubber; and (g) polysiloxaners.

12. A papermachine belt comprising a support structure in the form of a composite plastic membrane including at least two layers with aperatures of different sized, a nonwoven thermoplastic fusible layer over the support structure, and a nonwoven batt thereon, the whole structure being needled together and the thermoplastic layer malted by an application of heat.

13. The papermachine belt according to claim 12, wherein yarns are provided in the thermoplastic layer, said yarns running in one direction, which remains intact the termoplatic layer, said yarns running one direction and remining proud of the belt surface when the belt surface when the belt is not subject to nip pressure.

14. The papermachine belt according to claim 12, wherein the thermoplastic material is selected from the group compsising:

1. thermoplastic polyutrthane clastomers;
2. co-polymers of polyurchane and proyvinyl acetate;
3. polyether block amides;
4. polyster elastomers;
5. ionomer thermoplastic;
6. melt processable rubber and
7. polysiloxanes.

* * * * *